United States Patent [19]

Ciko et al.

[11] 3,984,335

[45] Oct. 5, 1976

[54] COMPOSITIONS FOR SOURING AND SOFTENING LAUNDERED TEXTILE MATERIALS AND STOCK SOLUTIONS PREPARED THEREFROM

[75] Inventors: John D. Ciko, Allen Park; John J. Cramer, Wyandotte, both of Mich.

[73] Assignee: BASF Wyandotte Corporation, Wyandotte, Mich.

[22] Filed: Jan. 16, 1975

[21] Appl. No.: 541,448

[52] U.S. Cl. ..... 252/8.6; 252/8.8; 260/29.6 XA

[51] Int. Cl.[2] ..... D06M 13/36; D06M 13/40; D06M 13/46; D06M 15/26

[58] Field of Search ..... 252/8.8, 8.6

[56] References Cited

UNITED STATES PATENTS

| | | | |
|---|---|---|---|
| 2,877,178 | 3/1959 | Bergman et al. | 252/8.8 |
| 3,003,954 | 10/1961 | Brown | 252/8.8 |
| 3,125,462 | 3/1964 | Rachinsky | 117/139.5 |
| 3,225,074 | 12/1965 | Cowen et al. | 260/404.5 |
| 3,325,404 | 6/1967 | Cohen et al. | 252/8.75 |
| 3,442,694 | 5/1969 | Sookne et al. | 117/126 |
| 3,475,207 | 10/1969 | Berch et al. | 117/143 |
| 3,546,115 | 12/1970 | Gill et al. | 252/8.8 |
| 3,594,224 | 7/1971 | Blackman | 117/139.5 |
| 3,619,115 | 11/1971 | Diehl et al. | 8/137 |
| 3,637,495 | 1/1972 | Eckert et al. | 252/8.8 |
| 3,681,241 | 8/1972 | Rudy | 252/8.75 |
| 3,743,534 | 7/1973 | Zamora | 117/109 |
| 3,749,691 | 7/1973 | Kandathil | 260/29.6 XA |
| 3,756,950 | 9/1973 | Gluck | 252/8.75 |
| 3,775,316 | 11/1973 | Berg et al. | 252/8.8 |
| 3,795,610 | 3/1974 | Eckert et al. | 252/8.8 |
| 3,809,646 | 5/1974 | Spence | 252/8.8 |
| 3,822,145 | 7/1974 | Liebowitz et al. | 117/139.5 A |

*Primary Examiner*—Donald E. Czaja
*Assistant Examiner*—E. A. Nielsen
*Attorney, Agent, or Firm*—Bernhard R. Swick; L. S. Van Landingham, Jr.; Robert E. Dunn

[57] ABSTRACT

Liquid and solid compositions are provided for souring and imparting softness to freshly laundered textile materials. When in the form of a stable homogeneous liquid, the composition may contain a quaternized fatty amide, a quaternized fatty amine, an aqueous emulsion of partially oxidized polyethylene or a fatty amphoteric compound as a softening agent, a water soluble organic acid containing about 1–20 carbon atoms and having a primary ionization constant between $10^{-1}$ and $10^{-5}$ as the souring agent, and water. When in the form of a stable dry solid, the composition may contain a quaternized fatty amide, a quaternized fatty amine or a fatty amphoteric compound as the softening agent, and a dry solid water soluble organic acid containing 2–20 carbon atoms and having a primary ionization constant between $10^{-1}$ and $10^{-5}$ as the souring agent. Stable homogeneous stock solutions are also prepared from the novel liquid or solid compositions of the invention.

44 Claims, No Drawings

COMPOSITIONS FOR SOURING AND SOFTENING LAUNDERED TEXTILE MATERIALS AND STOCK SOLUTIONS PREPARED THEREFROM

THE BACKGROUND OF THE INVENTION

1. The Field of the Invention

This invention broadly relates to novel compositions for souring laundered textile materials and simultaneously imparting softness thereto. The invention further relates to stock solutions for souring and softening laundered textile materials prepared from the novel compositions.

2. The Prior Art

The fibers of textile materials tend to harden and lose their initial soft finish when laundered repeatedly. The dry laundered textile materials also may be harsh and irritating to the skin under some conditions. As a result, softening finishes are applied for the purpose of imparting or restoring the softness properties. In most commercial laundries the softening finish is applied during the souring operation which follows the washing step and several rinses to remove residual detergent. The final rinse may be the souring operation and the softening finish is conveniently applied at that time.

Quaternized fatty amines are excellent softening agents for textile materials and are widely used for this purpose. However, at best they are only slightly soluble or marginally dispersable in aqueous solutions of inorganic acids of the types most often used in the souring operation and relatively concentrated stable homogeneous liquid compositions or stock solutions cannot be prepared therefrom. It is therefore necessary to make separate additions of the softening agent and the souring agent to the final rinse water in the washer. These separate additions, in turn, require separate inventories of the softening agent and the souring agent, separate auxiliary storage facilities therefor while awaiting use, and separate apparatus for making each of the two additions to modern commercial washers.

A suitable stable homogeneous composition containing the proper proportion and concentrations of the softening agent and the souring agent would possess a number of advantages which are attractive from the standpoints of convenience and efficiency. This is especially true when operating modern commercial laundry equipment of the type wherein bulk liquid washing chemicals are stored in auxiliary tanks and are added automatically to the washer through feed conduits at predetermined stages in the washing cycle. Entirely satisfactory compositions having the aforementioned characteristics were not available prior to the present invention due in part to the incompatible nature of the softening agents and the inorganic acid species which are commonly used as souring agents. If available, such compositons would allow the initial construction costs of commercial laundries to be reduced substantially as separate auxiliary apparatus would not be needed for storing and adding each ingredient. Labor and general operating costs would also be reduced substantially as only one addition need be made.

THE SUMMARY OF THE INVENTION

The compositions disclosed herein overcome the aforementioned deficiencies of the prior art. The present invention provides novel stable homogeneous liquid compositions and dry solid compositions for simultaneously souring and imparting softness to freshly laundered textile materials. In one variant, stable homogeneous aqueous liquid compositions are provided which contain certain specific softening agents and organic souring agents compatible therewith. Stable dry solid compositions are provided in a further variant which contain certain specific softening agents and organic souring agents compatible therewith. Novel stable homogeneous aqueous stock solutions are also prepared from the liquid or solid compositions of the invention.

The following detailed description and the specific examples may be referred to for a more complete and comprehensive understanding of the invention.

THE DETAILED DESCRIPTION OF THE INVENTION INCLUDING THE PREFERRED VARIANTS AND EMBODIMENTS THEREOF

In accordance with one presently preferred variant of the invention, stable homogeneous liquid compositions for souring freshly laundered textile materials and imparting softness thereto are provided which contain about 0.5–25% by weight and preferably about 1–15% by weight of a softening agent, about 7.5–75% by weight and preferably about 7.5–55% by weight of an organic acid souring agent, and about 0–92.0% by weight and preferably about 30–91.5% by weight of water. In accordance with another presently preferred variant of the invention, stable dry solid compositions for souring freshly laundered textile materials and imparting softness thereto are provided which contain about 5–50% by weight and preferably about 15–30% by weight of a softening agent, and about 50–95% by weight and preferably about 70–85% by weight of an organic acid souring agent. It will be appreciated that there are certain other preferred variants and embodiments of the invention which are discussed in greater detail hereinafter. All quantities and percentages mentioned hereinafter and recited in the claims are calculated on a weight basis unless specifically indicated to the contrary.

The aforementioned liquid composition of the invention contains one of the following softening agents for textile materials or admixtures of two or more of such softening agents:

A. Quaternized fatty amides corresponding to the following structural formulae

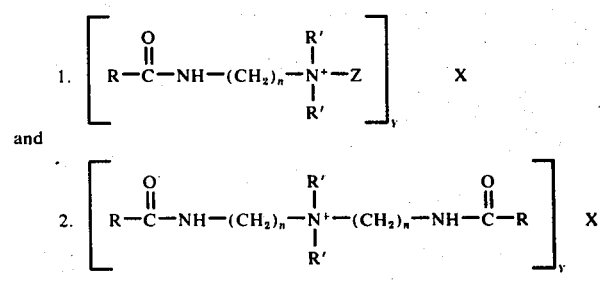

wherein R is selected from the group consisting of monovalent alkyl radicals and sulfonated monovalent alkyl radicals containing about 8–22 carbon atoms, R′ is selected from the group consisting of monovalent alkyl radicals and sulfonated monovalent alkyl radicals containing about 1–3 carbon atoms, Z is selected from the group consisting of monovalent alkyl radicals and sulfonated monovalent alkyl radicals containing about 1–22 carbon atoms, $n$ is about 1–6, X is an anion selected from the group consisting of halide, sulfate, phosphate, alkyl sulfates having about 1–3 carbon atoms in the alkyl group and alkyl phosphates having about 1–3 carbon atoms in the alkyl group, and Y is an integer having a numerical value equivalent to the valency of X.

B. Quaternized fatty amines corresponding to the following structural formula

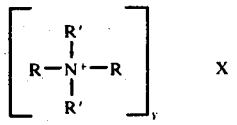

wherein R, R′, X and Y are as defined in (A) above.

C. An aqueous emulsion of partially oxidized emulsifiable polyethylene having a molecular weight of about 1000–10,000, and D. Fatty amphoteric compounds corresponding to the structural formula

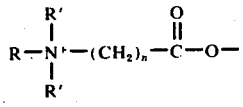

wherein R, R′, and $n$ are as defined in (A) above, the said amphoteric compounds having non-acidic isoelectric ranges.

The liquid composition also contains a water soluble organic acid containing about 1–20 carbon atoms and preferably about 2–10 carbon atoms and having a primary ionization constant between about $10^{-1}$ and $10^{-5}$ as an acidic souring agent for the freshly laundered textile materials, or admixtures of two or more of such organic acids. Preferred organic acids include acetic acid, citric acid, glycolic acid, maleic acid, malonic acid, oxalic acid and tartaric acid. Glycolic acid usually produces the best results.

In the foregoing structural formulae, R is preferably a monovalent alkyl radical containing about 12–18 carbon atoms and for still better results about 18 carbon atoms. R′ is preferably a monovalent alkyl radical containing one carbon atom, Z is preferably a monovalent alkyl radical containing either about one or about 12–18 carbon atoms, and $n$ preferably is an integer having a numerical value of about 1–3 for still better results about 1. X is preferably halide and in many instances is chloride. The numerical value of Y varies with the valence of X and may be 1, 2 or 3 depending upon the selected anion.

The molecular weight of the partially oxidized polyethylene in the aqueous emulsion is preferably about 1,400–5,000 and may be about 2,500 for still better results. The density is preferably about 0.93–1.05 and the carboxyl content may be, for example, about 0.2–2 milliequivalents per gram. The solids content of the emulsion may vary over wide ranges and may be, for example, about 5–50% by weight and preferably about 25% by weight. In calculating the amount of the emulsion to be used as a softening agent, it is understood that the calculations are made on a dry solids basis. The emulsifying agent for the emulsion may be a cationic, anionic or nonionic synthetic surfactant and is preferably a cationic synthetic surfactant. The emulsifying agent may be present in an amount of about 1–25% by weight and preferably about 5–10% by weight based upon the weight of the partially oxidized polyethylene. The partially oxidized polyethylene in one presently preferred emulsion has a ring and ball softening point of 223°F., a penetration (100 grams for 5 seconds) of 0.22 millimeter, a density of 0.940 g/cc, a Brookfield viscosity at 302°F. of 1,300 cps, a molecular weight of 2,500 and an acid number of 14.

The fatty amines and amides and fatty amphoteric compounds disclosed herein are well known commercially available products and may be prepared in accordance with the usual prior art processes. The aqueous emulsion of partially oxidized polyethylene is likewise a commercially available product and it may be prepared by the usual prior art processes. Examples of emulsions of partially oxidized polyethylene and the preparation thereof are disclosed in a number of United States patents including U.S. Patent Nos. 3,442,964 and 3,475,207, the disclosures of which are incorporated herein by reference.

The liquid composition preferably contains a quaternized fatty amine as the softening agent and glycolic acid as the souring agent. In instances where freeze-thaw stability is of importance, then the liquid composition preferably contains a quaternized fatty amide, or a quaternized fatty amine, or a fatty amphoteric compound, or an admixture of two or more thereof as a softening agent, and for best results glycolic acid as the souring agent. These latter liquid compositions reconstitute upon freezing and thawing and a precipitate or other nonhomogeneous phase is not formed.

It is understood that the aforementioned ingredients are present in proportions and in concentrations whereby a stable homogeneous liquid composition is produced. In most instances, the preferred concentrations and proportions of the ingredients may be determined by the Box or Factorial Methods of Experimental Design. Suitable procedures for making such determinations are disclosed in the text *Design and Analysis of Industrial Experiments*, edited by Owen L. Davies, and published by the Hafner Publishing Company, New York, New York (1956), the disclosure of which is incorporated herein by reference. This text has been assigned Library of Congress Card No. T 175.D 3. Chapters 10 and 11, i.e., pages 440–578, are especially pertinent.

The aforementioned solid composition of the invention contains a quaternized fatty amide, or a quaternized fatty amine, or a fatty amphoteric compound, or an admixture of two or more thereof. The quaternized fatty amides, the quaternized fatty amines and the fatty amphoteric compounds correspond to the structural formulae described previously for the liquid composition. The solid composition also contains a dry solid water soluble organic acid containing about 2–20 carbon atoms and having a primary ionization constant between $10^{-1}$ and $10^{-5}$ as a souring agent, or admixtures of two or more of such organic acids. The presently preferred organic acids for the solid composition include citric acid, fumaric acid, glycolic acid, maleic acid, malonic acid, oxalic acid and tartaric acid. Citric acid or glycolic acid is usually preferred. Inasmuch as the quaternized fatty amides, the quaternized fatty amines, the fatty amphoteric compounds and the organic acid souring agents are dry solids and are compatible, the solid composition may be prepared by uniformly admixing the ingredients in the proportions and concentrations disclosed herein to thereby produce a stable substantially homogeneous solid composition.

In instances where the solid composition is to be admixed with water to prepare a stock solution, then the preferred softening agent is a quaternized fatty amine and/or fatty amide, and the preferred souring agent is citric acid and/or glycolic acid. Citric acid and/or glycolic acid produce especially stable and homogeneous stock solutions. However, glycolic acid is deliquescent, and care must be taken to keep it dry during preparation of the solid composition and subsequently during storage. Citric acid is available in the anhydrous form commercially and thus is preferred in most instances.

The liquid and solid compositions of the invention are stable and homogeneous, and may be stored for long periods of time while awaiting use. Either composition may be added directly to the addition wheel of modern commercial washers. Inasmuch as the compositions are homogeneous or substantially homogeneous, additions in the exact required amounts of the active softening agent and souring agent may be made at the proper time in the washing cycle using automatic prior art metering or measuring apparatus and timing devices. Only the one addition need be made for the souring agent and the softening agent, and thus the auxiliary apparatus needed for storing, handling and adding softening and souring chemicals is reduced by approximately one-half. The labor and inventory costs are lower thereby effecting further economies in the overall laundering operation. The compositions of the present invention also assure that the softening agent and souring agent are added in the proper proportions, as well as in the proper concentrations, thereby simplifying the addition procedure. Unskilled or inexperienced personnel may be relied upon for making the proper additions.

The liquid and solid compositions of the invention may be added to the final rinse water, or they may be added at other suitable times in the washing cycle. Conventional practice may be followed with the exception of substituting one addition of a composition of the invention for the two additions of the softening agent and souring agent of the prior art. The compositions are added in amounts sufficient to provide the usual prior art quantities of active softening agent and active souring agent. For example, the liquid or solid composition may be added to the final rinse water in an amount to provide approximately 0.25–5 ounces and preferably about 0.25–3 ounces of the active softening agent and about 0.5–10 ounces and preferably about 1–2 ounces of the active souring agent per 100 pounds of dry textile material. While these qualities of softening agent and souring agent are generally satisfactory, it is understood that larger or smaller amounts may be added as needed in a specific instance.

The foregoing detailed description and the following specific examples are for purposes of illustration only, and are not intended as being limiting to the spirit or scope of the appended claims.

EXAMPLE I

This example illustrates the preparation of a stable homogeneous solution containing a commercial softening agent sold under the tradename Ceranine PNS and glycolic acid as a souring agent.

The composition contained 1.3% of the quaternized fatty amide, 8.5% of glycolic acid, and the remainder water. The ingredients were admixed and allowed to stand in the laboratory for over two months. The solution was observed periodically and it remained stable and homogeneous.

EXAMPLE II

This example illustrates the preparation of a stable homogeneous solution of an organic acid and a quaternized fatty amine for use in souring freshly laundered textile materials and imparting softness properties.

The softening agent was a dialkyl dimethyl ammonium chloride wherein the dialkyl group contained 16 to 18 carbon atoms and the organic acid was glycolic acid. The ingredients were admixed with water to provide a solution containing approximately 1.3% by weight of the dialkyl dimethyl ammonium chloride, 8.5% by weight of the glycolic acid and the remainder water. The solution was stable and homogeneous as prepared and remained stable and homogeneous upon observation.

EXAMPLE III

This example illustrates the preparation of a dry solid composition in accordance with the invention which is useful in the souring of freshly laundered textile materials and imparting softness properties.

The composition contained 20% by weight of dimethyl distearyl ammonium chloride as a softening agent, about 80% by weight of anhydrous citric acid, and small amounts of perfume and dye. The ingredients were finely subdivided and then admixed thoroughly to form a substantially homogeneous stable dry solid composition. The resulting composition was allowed to remain in the laboratory for three days and was observed during this period of time. There was no indication of decomposition or caking.

EXAMPLE IV

This example illustrates the preparation of a liquid composition for use in simultaneously souring freshly laundered textile materials and imparting softness properties. The softening agent was a fatty amphoteric compound and the souring agent was glycolic acid.

The liquid composition contained 3% by weight of a commercially available fatty amphoteric textile softening agent sold under the tradename MAFO 13, 28% by weight of glycolic acid and the remainder water. MAFO 13 is the potassium salt of a N-stearyl amino acid. The ingredients were admixed thoroughly and observed. The resulting solution was stable and homogeneous.

The above solution was frozen and then thawed. The solution reconstituted upon thawing and remained stable and homogeneous.

The above general procedure was repeated in a further run. In this run, the liquid composition contained 6% by weight of the fatty amphoteric softening agent, 35% by weight of glycolic acid and the remainder water. The resulting solution was stable and homogeneous as prepared. Also, the liquid composition reconstituted upon freezing and thawing and remained stable and homogeneous.

EXAMPLE V

This example illustrates the use of a liquid composition containing 1.3% by weight of a commercial softening agent sold under the tradename Ceranine PNS, 8.5% by weight of glycolic acid and the remainder water for simultaneously souring and softening freshly laundered textile materials.

A 25 pound Milnor Washer-Extractor was used in this example. A wash net was filled with 25 pounds of Dacron-cotton filler. Swatches of 4 × 4 inches terry-cloth were also placed in the net and the filled net was placed in the washer. The washer was filled with six inches of water having a temperature of 160°F., 4 ounces of a mixture containing equal weights of sodium carbonate and anhydrous sodium metasilicate was added, and the load was washed for a period of 30 minutes. During the second or carry over operation which followed, the washer was run for five minutes at the six inch water level. The water had a temperature of 160°F., and no chemicals were added. The third operation was carried out for 2 minutes using the flush twelve inch water level. The water had a temperature of 160°F and no chemicals were added.

The fourth operation was the bleach using trichlorocyanuric acid as the bleaching agent. The water level was 6 inches, the temperature was 160°F, and the bleaching time was 7 minutes. The bleach was followed by the fifth and sixth operations which were rinses. The water level was twelve inches in each rinse, the water temperature was 140°F and 120°F respectively, and the rinse time was 2 minutes in each rinse.

The seventh operation was the souring-softening step and several of the washed swatches were removed for use in the tests which follow. The water level was 6 inches and the water temperature was 100°F. The souring-softening addition was 600 milliliters of a liquid composition containing 1.3% by weight of a commercial softening agent sold under the tradename Ceranine PNS, 8.75% by weight of glycolic acid and the remainder water. The souring-softening composition was added in an amount to provide one ounce of the active softening agent per hundredweight of textile material, and the glycolic acid was added in an amount to provide seven ounces of souring agent per hundredweight of textile material. The load was thereafter hydroextracted for 30 seconds and tumble dried.

The pH of the wash water was 11.2. The pH of the water from the souring-softening operation was 3.8 thereby indicating a reversal in pH. The pH of the washed textile material was 4.5–5.5 which demonstrates that it was properly soured.

Four sets of swatches were prepared containing one of the softened swatches and one of the untreated swatches. The four sets of swatches were examined by different individuals and each immediately distinguished between the softened swatch and the untreated swatch. Thus the treated swatches were adequately softened.

The above swatches were further tested in a standard wicking test. A dye solution was prepared and the samples were partially immersed therein. The time required for the dye solution to wick 1 and 2 inches up on the swatch was determined in seconds. The untreated swatches wicked 2 inches after 25–30 seconds. The softened swatches did not wick 1 inch in 1,000 seconds, thereby demonstrating that the softening agent is substantitive to the fabric.

EXAMPLE VI

The general procedure of Example V was repeated up to the seventh operation, i.e., the souring-softening operation. The souring-softening operation in this example employed a dry uniform admixture containing 20% by weight of dimethyl distearyl ammonium chloride and 80% by weight of anhydrous citric acid. The souring-softening composition was added in an amount to provide 1.6 ounces of the active softening agent and 6.4 ounces of citric acid per 100 pounds by weight of textile material.

The pH of the wash water was 11.0, and the pH of the water following the souring-softening operation was 3.4. The pH of the textile material following souring was 4.5–5.5.

The swatches were tested for softness following the general procedure of Example V and comparable results were obtained. The softened swatches were much softer and the four individuals were able to distinguish immediately between the softened swatches and the untreated swatches. The wicking test of Example V was repeated on the swatches produced in this Example with comparable results. The softened samples required more than 1000 seconds to wick 2 inches, whereas the untreated swatches wicked in approximately 25–30 seconds.

We claim:

1. A stable homogeneous liquid composition for souring laundered textile materials and imparting softness thereto comprising:

I. About 0.5–25% by weight of a softening agent for textile materials selected from the group consisting of A. Quaternized fatty amides corresponding to the following structural formulae

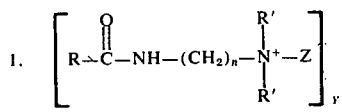

1.

and

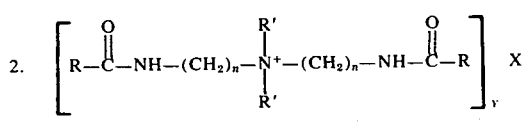

2.

wherein R is selected from the group consisting of monovalent alkyl radicals and sulfonated monovalent alkyl radicals containing about 8–22 carbon atoms, R′ is selected from the group consisting of monovalent alkyl radicals and sulfonated monovalent alkyl radicals containing about 1–3 carbon atoms, Z is selected from the group consisting of monovalent alkyl radicals and sulfonated monovalent alkyl radicals containing about 1–22 carbon atoms, *n* is about 1–6, X is an anion selected from the group consisting of halide, sulfate, phosphate, alkyl sulfates having about 1–3 carbon atoms in the alkyl group and alkyl phosphates having about 1–3 carbon atoms in the alkyl group, and Y is an integer having a numerical value equivalent to the valency of X;

B. Quaternized fatty amines corresponding to the following structural formula

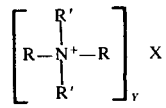

wherein R, R′, X and Y are as defined in (A) above;

C. An aqueous emulsion of partially oxidized emulsifiable polyethylene having a molecular weight of about 1000–10,000, and D. Fatty amphoteric compounds corresponding to the structural formula

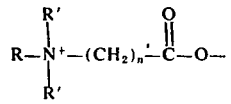

wherein R, R′ and $n$ are as defined in (A) above, the said amphoteric compounds having non-acidic isoelectric ranges;

II. About 7.5–75% by weight of an acidic souring agent for laundered textile materials, the souring agent being a water soluble organic carboxylic acid containing about 2–10 carbon atoms and having a primary ionization constant between $10^{-1}$ and $10^{-5}$, and III. About 0–92% by weight of water;

the said ingredients I and II being present in amounts whereby laundered textile materials are effectively softened and simultaneously soured upon treatment with the said liquid composition, and the said ingredients I, II and III being present in amounts whereby a stable homogeneous liquid composition is produced.

2. The liquid composition of claim 1 wherein the softening agent is present in an amount of about 1–15% by weight.

3. The liquid composition of claim 1 wherein the souring agent is present in an amount of about 7.5–55% by weight.

4. The liquid composition of claim 1 wherein the softening agent is present in an amount of about 1–15% by weight, the souring agent is present in an amount of about 7.5–55% by weight, and water is present in an amount of about 30–91.5% by weight.

5. The liquid composition of claim 1 wherein the softening agent is a quaternized fatty amine.

6. The liquid composition of claim 1 wherein the souring agent is selected from the group consisting of acetic acid, citric acid, glycolic acid, maleic acid, malonic acid, oxalic acid and tartaric acid.

7. The liquid composition of claim 1 wherein the souring agent is glycolic acid.

8. The liquid composition of claim 1 wherein the softening agent is a quaternized fatty amine and the souring agent is glycolic acid.

9. The liquid composition of claim 1 wherein R is a monovalent alkyl radical containing about 12–18 carbon atoms.

10. The liquid composition of claim 1 wherein R′ is a monovalent alkyl radical containing one carbon atom.

11. The liquid composition of claim 1 wherein Z is selected from the group consisting of monovalent alkyl radicals containing about one carbon atom and about 12–18 carbon atoms.

12. The liquid composition of claim 1 wherein $n$ is about 1–3.

13. The liquid composition of claim 1 wherein X is halide.

14. The liquid composition of claim 1 wherein R is a monovalent alkyl radical containing about 12–18 carbon atoms, R′ is a monovalent alkyl radical containing about one carbon atom, Z is selected from the group consisting of alkyl radicals containing about one carbon atom and about 12–18 carbon atoms, $n$ is about 1 and X is chloride.

15. The liquid composition of claim 1 wherein the softening agent is an emulsion of partially oxidized polyethylene and the molecular weight of the partially oxidized polyethylene is about 1400–5000.

16. The liquid composition of claim 15 wherein the molecular weight of the partially oxidized polyethylene is about 2500.

17. The liquid composition of claim 1 wherein the softening agent is (A), (B), or (D), or admixtures of two or more thereof, and the resulting liquid composition is freeze-thaw stable.

18. The liquid composition of claim 17 wherein the souring agent is glycolic acid.

19. A stable homogeneous aqueous stock solution for souring and softening laundered textile materials prepared by diluting the liquid composition of claim 1 with water.

20. A stable homogeneous aqueous stock solution for souring and softening laundered textile materials prepared by diluting the liquid composition of claim 5 with water.

21. A stable homogeneous aqueous stock solution for souring and softening laundered textile materials prepared by diluting the liquid composition of claim 7 with water.

22. A stable homogeneous aqueous stock solution for souring and softening laundered textile materials prepared by diluting the liquid composition of claim 8 with water.

23. A stable homogeneous aqueous stock solution for souring and softening laundered textile materials prepared by diluting the liquid composition of claim 17 with water.

24. A stable homogeneous aqueous stock solution for souring and softening laundered textile materials prepared by diluting the liquid composition of claim 18 with water.

25. A stable dry solid composition for souring laundered textile materials and imparting softness thereto comprising:

I. About 5–50% by weight of a softening agent for textile materials selected from the group consisting of A. Quaternized fatty amides corresponding to the following structural formulae

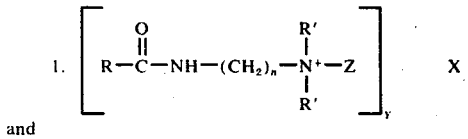

and

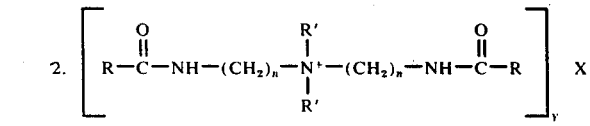

wherein R is selected from the group consisting of monovalent alkyl radicals and sulfonated monovalent alkyl radicals containing about 8–22 carbon atoms, R′ is selected from the group consisting of monovalent alkyl radicals and sulfonated monovalent alkyl radicals containing about 1–3 carbon atoms, Z is selected from the group consisting of monovalent alkyl radicals and sulfonated monovalent alkyl radicals containing about 1–22 carbon atoms, $n$ is about 1–6, X is an anion selected from the group consisting of halide, sulfate, phosphate, alkyl sulfates having about 1–3 carbon atoms in the alkyl group and alkyl phosphates having about 1–3 carbon atoms in the alkyl group, and Y is an integer having a numerical value equivalent to the valency of X;

B. Quaternized fatty amines corresponding to the following structural formula

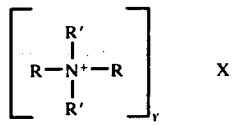

wherein R, R′, X and Y are as defined in (A) above, and

C. Fatty amphoteric compounds corresponding to the structural formula

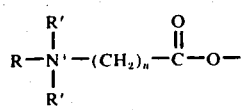

wherein R, R′ and *n* are as defined in (A) above, the said amphoteric compounds having non-acidic isoelectric ranges, and II. About 95–50% by weight of an acidic souring agent for laundered textile materials, the souring agent being a dry solid water soluble organic carboxylic acid containing about 2–10 carbon atoms and having a primary ionization constant between $10^{-1}$ and $10^{-5}$, the said ingredients I and II being present in amounts whereby laundered textile materials are effectively softened and simultaneously soured upon treatment with an aqueous solution for souring textile materials containing the said dry solid composition, and the said ingredients I and II being present in amounts whereby a stable solid composition is produced for souring laundered textile materials and imparting softness thereto.

26. The dry solid composition of claim 25 wherein about 15–30% by weight of the softening agent and about 70–85% by weight of the souring agent are present.

27. The dry solid composition of claim 25 wherein the softening agent is a quaternized fatty amine.

28. The dry solid composition of claim 25 wherein the souring agent is selected from the group consisting of citric acid, fumaric acid, glycolic acid, maleic acid, malonic acid, oxalic acid and tartaric acid.

29. The dry solid composition of claim 25 wherein the souring agent is citric acid.

30. The dry solid composition of claim 25 wherein the souring agent is glycolic acid.

31. The dry solid composition of claim 25 wherein the softening agent is a quaternized fatty amine and the souring agent is citric acid.

32. The dry solid composition of claim 25 wherein the softening agent is a quaternized fatty amine and the souring agent is glycolic acid.

33. The dry solid composition of claim 25 wherein R is a monovalent alkyl radical containing about 12–18 carbon atoms.

34. The dry solid composition of claim 25 wherein R′ is a monovalent alkyl radical containing one carbon atom.

35. The dry solid composition of claim 25 wherein Z is selected from the group consisting of monovalent alkyl radicals containing about one carbon atom and about 12–18 carbon atoms.

36. The dry solid composition of claim 25 wherein *n* is about 1–3.

37. The dry solid composition of claim 25 wherein X is halide.

38. The dry solid composition of claim 25 wherein R is a monovalent alkyl radical containing about 12–18 carbon atoms, R′ is a monovalent alkyl radical containing about one carbon atom, Z is selected from the group consisting of alkyl radicals containing about one carbon atom and about 12–18 carbon atoms, *n* is about 1 and X is chloride.

39. A stable homogeneous aqueous stock solution for souring and softening laundered textile materials prepared by admixing the dry solid composition of claim 25 with water.

40. A stable homogeneous aqueous stock solution for souring and softening laundered textile materials prepared by admixing the dry solid composition of claim 27 with water.

41. A stable homogeneous aqueous stock solution for souring and softening laundered textile materials prepared by admixing the dry solid composition of claim 29 with water.

42. A stable homogeneous aqueous stock solution for souring and softening laundered textile materials prepared by admixing the dry solid composition of claim 30 with water.

43. A stable homogeneous aqueous stock solution for souring and softening laundered textile materials prepared by admixing the dry solid composition of claim 31 with water.

44. A stable homogeneous aqueous stock solution for souring and softening laundered textile materials prepared by admixing the dry solid composition of claim 32 with water.

* * * * *